US005474625A

United States Patent [19]

Duong et al.

[11] Patent Number: 5,474,625

[45] Date of Patent: Dec. 12, 1995

[54] DESENSITIZED SOLID ROCKET PROPELLANT FORMULATION

[75] Inventors: Anh N. Duong, Burtonsville; George B. Wilmot, Bryans Road, both of Md.

[73] Assignee: The United States of America as represented by the Secretary of the Navy, Washington, D.C.

[21] Appl. No.: 167,251

[22] Filed: Dec. 16, 1993

[51] Int. Cl.[6] ..... C06B 29/22

[52] U.S. Cl. ..... 149/77; 149/76

[58] Field of Search ..... 149/76, 77

[56] References Cited

U.S. PATENT DOCUMENTS 3,986,908 10/1976 Grebert et al. ..... 149/19.7

4,246,051 1/1981 Garner et al. ..... 149/7

4,776,993 10/1988 Chang ..... 263/3.3

4,881,994 11/1989 Rudy et al. ..... 149/109.4

*Primary Examiner*—Donald P. Walsh

*Assistant Examiner*—Anthony R. Chi

*Attorney, Agent, or Firm*—Roger D. Johnson

[57] ABSTRACT

A composite propellant composition and process are disclosed for reducing the reactive violence during cook-off and to improve the performance of a potassium perchlorate/ammonium perchlorate propellant composition wherein 0.25–2.0% by weight, of iron oxide replaces 0.25–2.0% by weight, of potassium perchlorate in the composition.

10 Claims, 1 Drawing Sheet

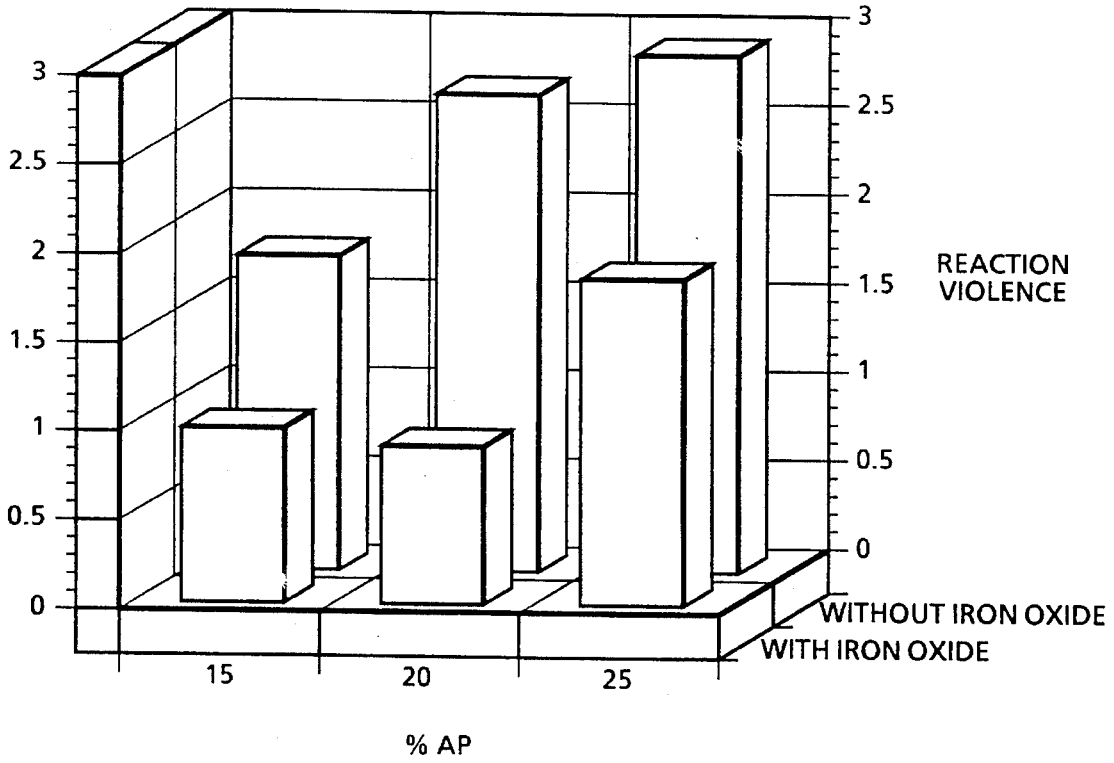
3
2.5
2
1.5
1
0.5
0
REACTION VIOLENCE
WITHOUT IRON OXIDE
WITH IRON OXIDE
15
20
25
% AP

DESENSITIZED SOLID ROCKET PROPELLANT FORMULATION

The invention relates to solid rocket propellants and explosives, in general, and relates specifically to the application of additives to solid composite propellant compositions to reduce the "cook-off" sensitivity thereof.

BACKGROUND OF THE INVENTION

The term "cook-off" as used herein means the exposure of a propellant to an external source of heat that can lead to unplanned ignition, explosion, or chemical deterioration of the propellant to such an extent as to self destruct, made dangerous to handle, or rendered ineffective for its intended function. Fast "cook-offs" may occur when a propellant charge is exposed to a flame environment such as may be encountered by missiles carried by an aircraft that is hit by enemy fire and resulting in a fire in the aircraft fuel tanks. Slow "cook-offs" may occur when a missile is stored in an area of increased temperature such as in a bunker and influenced by heat from a fire in an adjacent bunker.

Most current tactical composite propellants contain ammonium perchlorate (AP) as the main oxidizer. Ammonium perchlorate containing propellants often respond quite violently to unplanned-for hazards, especially in cook-off scenarios. Hence, it would seem desirable to replace ammonium perchlorate with a more thermally stable oxidizer. However, in a slow cook-off scenario a higher oxidizer decomposition temperature may not always imply a reaction of lessened violence. Instead, what might be anticipated is a longer interval until thermally-induced damage, self-heating and violent "whole mass" participation of the propellant is realized. Hence, a small proportion of a less thermally stable ingredient might be incorporated into the formulation to function as a "thermal trigger". Thus, early, mild initiation of the propellant and preemption of a severe slow cook-off reaction may be accomplished.

Potassium perchlorate (KP) is highly preferred among the existing thermally-stable oxidizers due to its ready availability, relatively low cost and ease in processing. For potassium perchlorate propellants, ammonium perchlorate has been demonstrated to be an excellent "trigger". At 15–20% ammonium perchlorate levels, these propellants exhibit good processability and mechanical properties while offering reduced sensitivity to cook-off. They also show a mild performance gain as potential candidate propellants for certain surface-to-surface and surface-to-air missiles. The disadvantage, however, lies in an increase in motor weight since potassium perchlorate, like most other thermally-stable oxidizers, is significantly more dense than ammonium perchlorate. It is also desirable, and in many cases necessary, to decrease the relatively high burning rate exponent often exhibited by potassium perchlorate propellants.

As the ammonium perchlorate content of potassium perchlorate based propellants increases (through a trade-off with potassium perchlorate), propellant specific impulse (performance) increases, while its density (motor weight) decreases. The propellant burning rate exponent also decreases with increasing ammonium perchlorate content. On the other hand, a higher ammonium perchlorate content yields a higher propellant cook-off response as the ammonium moves away from its role of "thermal trigger" into one of dominant oxidizer.

Accordingly, it is an object of the present invention to provide a potassium perchlorate propellant composition having an increased quantity of ammonium perchlorate beyond the level normally tolerated by such a propellant before a significant loss of cook-off advantage occurs.

Another object of the present invention is to add a small quantity of iron oxide to a potassium perchlorate/ammonium perchlorate propellant formulation to reduce the relative violence of the propellant reaction during cook-off.

SUMMARY OF THE INVENTION

According to the present invention the foregoing and additional objects are attained by providing adding a quantity of a desensitizing agent to a potassium perchlorate/ammonium perchlorate propellant formulation. In specific examples of the present invention a quantity of iron oxide was substituted for a like quantity of potassium perchlorate in various propellant formulations containing potassium/ammonium perchlorate and, in each instance, the relative violence of the resulting propellant formulation during cook-off was substantially reduced.

BRIEF DESCRIPTION OF THE DRAWING

The single drawing FIGURE is a graphical representation of slow cook-off visualization test results tabulated in Table II and illustrating reaction violence changes achieved by adding a small quantity of iron oxide to replace a like quantity of potassium perchlorate in various percentage compositions of potassium/aluminum perchlorate propellant charges.

DETAILED DESCRIPTION AND SPECIFIC EXAMPLES

The potassium/aluminum perchlorate propellant compositions employed in the specific examples of the present invention had the propellant formulation matrix displayed in Table I:

TABLE I

| INGREDIENTS | NOMINAL WEIGHT % | FUNCTION |
|---|---|---|
| Hydroxyl Terminated Polybutadiene, R45M and Isophorone Diisocyanate | 7–10 | Binder Curing Agent |
| Aluminum | 0–20 | Fuel |
| Potassium Perchlorate | 30–55 | Oxidizer |
| Ammonium Perchlorate | 15–40 | Thermal Trigger |
| Dioctyl Adipate | 0–4 | Plasticizer |
| Iron Oxide (.003 micron) | 0.25–2.0 | Desensitizing Agent |
| Hydantoin Epoxy Resin, XU 238 | 0–0.4 | Bonding Agent |
| Diethylene Triamine | 0–0.08 | Bonding Agent |
| A02246 (2,2'-methylene bis(4-methyl-6-tertiary butyl phenol) | 0.1 | Stabilizer |
| Phenyl Diisodecyl Phosphite | 0–0.2 | Anti-Ozonant |
| Triphenyl Bismuth | 0–0.10 | Cure Catalyst |

Specific Examples of the propellant formulation illustrated in Table I were made and subjected to slow cook-off visualization (SCV) tests. The iron oxide ($Fe_2O_3$) employed in each Example was a commercial brand Iron Oxide blended into the formulation and available under the trade name NANOCAT, (from MACH I, Inc. 340 East Church Road, King of Prussia, Pa. 19406.

The slow cook-off visualization test results for some of the specific examples are set forth in Table II below and graphically shown in the single FIGURE of the drawing. As noted, at each ammonium perchlorate level (i.e. 15, 20, 25%), the iron oxide containing composition was identical to its non-iron oxide counterpart, except for the presence of 0.5% iron oxide (compensated for by 0.5% less potassium perchlorate).

The slow cook-off visualization test results for selected specific Examples are tabulated in Table II.

TABLE II

| Test No. | Designation | Composition AP/KP/$Fe_2O_3$ (Wt %) | Oven Temp (C.) | Sample Temp (C.) | Relative Violence* |
|---|---|---|---|---|---|
| 28 | P283(IMAD2) | 15/55/0.0** | 249.2 | 190.8 | 1.5 |
| 29 | P368(IMAD8) | 15/55/0.0 | 225.3 | 294.7 | 1.5 |
| 33 | P368(IMAD8) | 15/55/0.0 | 229 | 290 | 2 |
| 31 | P367(IMAD7) | 15/55/0.5 | 185.6 | 226.6 | 1 |
| 38 | 2881(IMAD30) | 19.9/49.8/0.0 | 278.8 | 356.6 | 2.7 |
| 35 | P208(IMAD29) | 19.9/49.3/0.5 | 188.1 | 235 | 1 |
| 36 | 288J(IMAD31) | 24.8/44.6/0.0 | 258 | 366.2 | 3 |
| 34 | P207(IMAD28) | 24.8/44.6/0.5 | 189.9 | 248.7 | 2 |

*Comparative scale:
0 = no reaction;
1 = quiescent burn;
10 = detonation
**This composition contains DHE (instead of XU238 and Diethylene Triamine) bonding agent. It also contains oxalic acid as a cure retardant.

It is thus seen that the ammonium perchlorate/potassium perchlorate propellants, without iron oxide, reacted at temperatures that were higher than the ammonium perchlorate decomposition temperature of 190°–200° C. but significantly lower than the potassium perchlorate decomposition temperature (610° C.). This confirms the triggering role of ammonium perchlorate, as these propellants reacted sufficiently early, in all cases, to preempt a potentially violent, whole-mass response. Iron oxide, which is commonly used as a burn rate catalyst for ammonium perchlorate based propellants, apparently accelerated this process, as all formulations containing iron oxide reacted at even lower temperatures than did their counterparts. It is well known that thermally or mechanically damaged energetic materials react more violently in hazards tests. Hence, the earlier a thermally stable propellant can be triggered to react in a cook-off, the less thermal damage that propellant is likely to have sustained at the point of initiation. Thus, a response of lessened violence would be anticipated.

The novel application of iron oxide as a cook-off desensitizing agent further reduces the cook-off response of thermally stable propellants containing ammonium perchlorate as the thermal trigger. For the same ammonium perchlorate/potassium perchlorate ratio in such propellant, the addition of iron oxide provides reduced cook-off response. Alternatively, for the same level of cook-off response, the addition of iron oxide permits an increase in ammonium perchlorate/potassium perchlorate ratio which results in performance increase, lower burning rate exponent and lower motor chamber and exhaust temperatures.

Although the invention has been described relative to specific examples thereof, it is not so limited. There are many variations and modifications of the invention that will be readily apparent to those skilled in the art in the light of the above teachings.

It is therefore to be understood that, within the scope of the appended claims, the invention may be practiced other than exactly as described herein.

What is claimed is:

1. An improved composite propellant composition containing 30–55%, by weight, of an oxidizer; 15–40%, by weight, of a thermal trigger; 0.25–2.0% by weight, of a desensitizing agent, and the remainder of the composition comprising a quantity of one or more of, a binder; a curing agent; a fuel; a plasticizer; a bonding agent; a stabilizer; an anti-ozonant; and, a cure catalyst.

2. The improved composite propellant composition of claim 1 wherein the oxidizer is potassium perchlorate, the thermal trigger is ammonium perchlorate and the desensitizing agent is iron oxide.

3. The improved composite propellant composition of claim 2 wherein the combined binder and curing agent constitutes approximately seven to ten percent, by weight, of the total composite propellant composition, and wherein the binder is a hydroxyl terminated polybutadiene and the curing agent is isophorone diisocyanate.

4. The improved composite propellant composition of claim 2 wherein the fuel is aluminum powder and constitutes up to twenty percent, by weight, of the total composite propellant composition.

5. The improved composite propellant composition of claim 2 wherein the plasticizer is dioctyl adipate; the bonding agent includes both hydantoin epoxy resin and diethylene triamine; the stabilizer is 2,2'-methylene his (4-methyl-6-tertiary butyl phenol); the anti-ozonant is phenyl diisodecyl phosphite; the cure catalyst is triphenyl bismuth; and the combined percentage of the plasticizer, bonding agent, stabilizer, anti-ozonant, and cure catalyst is less than five percent, by weight, of the composite propellant composition.

6. A process of reducing the reaction violence of a composite propellant composition during cook-off comprising the steps of decreasing the weight percent of the oxidizer or polymer in the composition and adding an equal weight percent of a desensitizing agent.

7. The process of claim 6 wherein the composite propellant composition contains 30–55%, by weight, of the oxidizer potassium perchlorate and 15–40% by weight, of ammonium perchlorate as a thermal trigger and, wherein the desensitizing agent comprises 0.25–2.0%, by weight, of iron oxide.

8. A method of reducing the cook-off reaction violence, while simultaneously improving the performance, of a composite propellant containing 30–55% by weight, of potassium perchlorate; 15–40%, by weight, of an ammonium perchlorate thermal trigger; and a quantity of one or more of, a binder; a curing agent; a fuel; a plasticizer; a bonding agent; a stabilizer; an anti-ozonant; and a cure catalyst; comprising the steps of reducing the weight percentage of the potassium perchlorate by 0.25–2.0% by weight, and replacing it with 0.25∝2.0%, by weight, of a desensitizing agent.

9. The method of claim 8 wherein the desensitizing agent is iron oxide.

10. The method of claim 9 wherein the fuel is aluminum powder and constitutes approximately up to twenty percent, by weight, of the composite propellant composition; the plasticizer is dioctyl adipate and constitutes approximately up to four percent, by weight, of the composite propellant composition; and the combined percentage, by weight, of the bonding agent, the stabilizer, the anti-ozonant and the cure catalyst is less than one percent of the total weight of the composite propellant composition.

* * * * *